US005734399A

United States Patent [19]

Weber et al.

[11] Patent Number: 5,734,399

[45] Date of Patent: Mar. 31, 1998

[54] PARTICLE TOLERANT INKJET PRINTHEAD ARCHITECTURE

[75] Inventors: Timothy L. Weber; Peter M. Burke, both of Corvallis, Oreg.

[73] Assignee: Hewlett-Packard Company, Palo Alto, Calif.

[21] Appl. No.: 500,796

[22] Filed: Jul. 11, 1995

[51] Int. Cl.[6] ..... B41J 2/05; B41J 2/175

[52] U.S. Cl. ..... 347/65; 347/93

[58] Field of Search ..... 347/65, 93

[56] References Cited

U.S. PATENT DOCUMENTS

| | | | |
|---|---|---|---|
| 4,394,670 | 7/1983 | Sugitani et al. | 347/65 |
| 4,771,295 | 9/1988 | Baker et al. | 347/87 |
| 4,875,059 | 10/1989 | Masuda | 347/93 |
| 4,885,932 | 12/1989 | Hefferman et al. | 73/53 |
| 5,025,271 | 6/1991 | Baker et al. | 347/87 |
| 5,463,413 | 10/1995 | Ho | 347/95 X |
| 5,519,424 | 5/1996 | Scardovi | 347/65 |

FOREIGN PATENT DOCUMENTS

| | | | |
|---|---|---|---|
| 314486 | 10/1988 | European Pat. Off. | B41J 3/04 |
| 500068 | 8/1992 | Japan | B41J 2/175 |

*Primary Examiner*—Joseph W. Hartary
*Attorney, Agent, or Firm*—Raymond A. Jenski

[57] ABSTRACT

In order to reduce particle clogging of ink firing chambers in an inkjet printer printhead, the barrier layer is configured to have a plurality of inner barrier islands, each associated with a respective one of the heater resistors, disposed between an ink firing chamber and the ink plenum, to form two ink feed channels. The two ink feed channels are designed to have a right angle turn to prevent particles from entering the ink firing chamber. A plurality of outer barrier islands, having a number equal to twice the number of inner barrier islands, are disposed between the inner barrier islands and the ink plenum, and are configured in lines parallel to the lines of heater resistors to prevent particles from reaching the ink feed channels.

20 Claims, 5 Drawing Sheets

— PRIOR ART —

— PRIOR ART —

— PRIOR ART —

PARTICLE TOLERANT INKJET PRINTHEAD ARCHITECTURE

BACKGROUND OF THE INVENTION

The present invention is generally related to a printhead for an inkjet printer and more particularly related to the design of barrier materials within the printhead to reduce particle clogging of ink firing chambers.

Thermal inkjet printers operate by expelling a small volume of ink through a plurality of small nozzles or orifices in a surface held in proximity to a medium upon which marks or printing is to be placed. These orifices are arranged in a fashion in the surface such that the expulsion of a droplet of ink from a determined number of orifices relative to a particular position of the medium results in the production of a portion of a desired character or image. Controlled repositioning of the substrate or the medium and another expulsion of ink droplets continues the production of more pixels of the desired character or image. Inks of selected colors may be coupled to individual arrangements of orifices so that selected firing of the orifices can produce a multicolored image by the inkjet printer.

Expulsion of the ink droplet in a conventional thermal inkjet printer is a result of rapid thermal heating of the ink to a temperature which exceeds the boiling point of the ink solvent and creates a gas phase bubble of ink. Each orifice is coupled to a small unique ink firing chamber filled with ink and having an individually addressable heating element resistor thermally coupled to the ink. As the bubble nucleates and expands, it displaces a volume of ink which is forced out of the orifice and deposited on the medium. The bubble then collapses and the displaced volume of ink is replenished from a larger ink reservoir by way of ink feed channels.

After the deactivation of the heater resistor and the expulsion of ink from the firing chamber, ink flows back into the firing chamber to fill the volume vacated by the ink which was expelled. A problem which occasionally manifests itself in inkjet printheads is that of a blockage occurring in an ink feed channel. Microscopic particles can become lodged in the ink firing chamber causing premature failure of the heater resistor or become lodged in the narrow ink feed channel and starve the ink firing chamber of ink. A single orifice which does not fire an ink droplet when it is commanded to do so will leave a missing portion out of a printed character and will leave an unprinted band on the medium when a solid image is to be printed. This results in a poorer quality of printed matter, highly undesirable for an inkjet printer. To resolve this undesirable characteristic, others have suggested using spare or redundant orifices to eject ink in place of the defective orifice (see U.S. Pat. No. 4,963,882 and U.S. patent application Ser. No. 08/277,723, "Redundant Nozzle Dot Matrix Printheads and Methods of Use", filed on behalf of David E. Hackleman on Jul. 20, 1994) or multiple inlets to the ink firing chamber.

Ink for inkjet printing is conventionally stored in a chamber associated with the printhead mechanism. For reasons associated with ink retention and fluid pressures within the print cartridge encompassing both the printhead and the ink containment apparatus, the ink can further be stored in a porous material within the storage chamber. A disadvantage of the porous material is that elongate, fiberous particles occasionally disengage from the porous material and are carried by the ink to the printhead despite special cleaning processes (such as described in U.S. Pat. No. 4,885,932) or filtering which occurs prior to the ink entering the printhead (such as described in U.S. Pat. Nos. 4,771,295 and 5,025,271). U.S. patent application Ser. No. 08/072,298 "Internal Support for Thermal Ink-Jet Printhead" filed on behalf of Ho et al. on Jun. 3, 1993, now U.S. Pat. No. 5,463,413 discloses a plurality of pillars, each pillar associated with the entrance to a firing chamber. The pillars are spaced apart by an amount less than or equal to the smallest dimension of the system, and are placed as close as possible to a common ink feed channel to keep particles outside the firing chamber. The smallest dimension of the system is likely to be either the nozzle size or the width of the passageway connecting the source of ink to the firing chamber. Efforts have been made to further screen or filter the ink with a fine mesh screen before it reaches the firing chamber or add redundant channels for ink to reach the firing chamber but the results of this additional tikering or redundancy have not provided an effective solution for elongate particles.

SUMMARY OF THE INVENTION

A barrier layer for an inkjet printhead, which utilizes heater resistors disposed essentially in one or more parallel lines on a substrate, is formed in association with the heater resistors to create an ink firing chamber at each heater resistor and an ink plenum which contains ink for distribution to at least some of the ink firing chambers. A plurality of inner barrier islands, each associated with a respective one of the heater resistors, is disposed between an ink tiring chamber associated with the respective one of the heater resistors and the ink plenum, to form two ink feed channels to enable ink to be supplied to the firing resistor. A plurality of outer barrier islands, having a number equal to twice the number of inner barrier islands, are disposed between the inner barrier island and the ink plenum, and are arranged essentially in lines parallel to the one or more parallel lines of heater resistors.

DETAILED DESCRIPTION OF THE PREFERRED EMBODIMENTS

Figure 1:
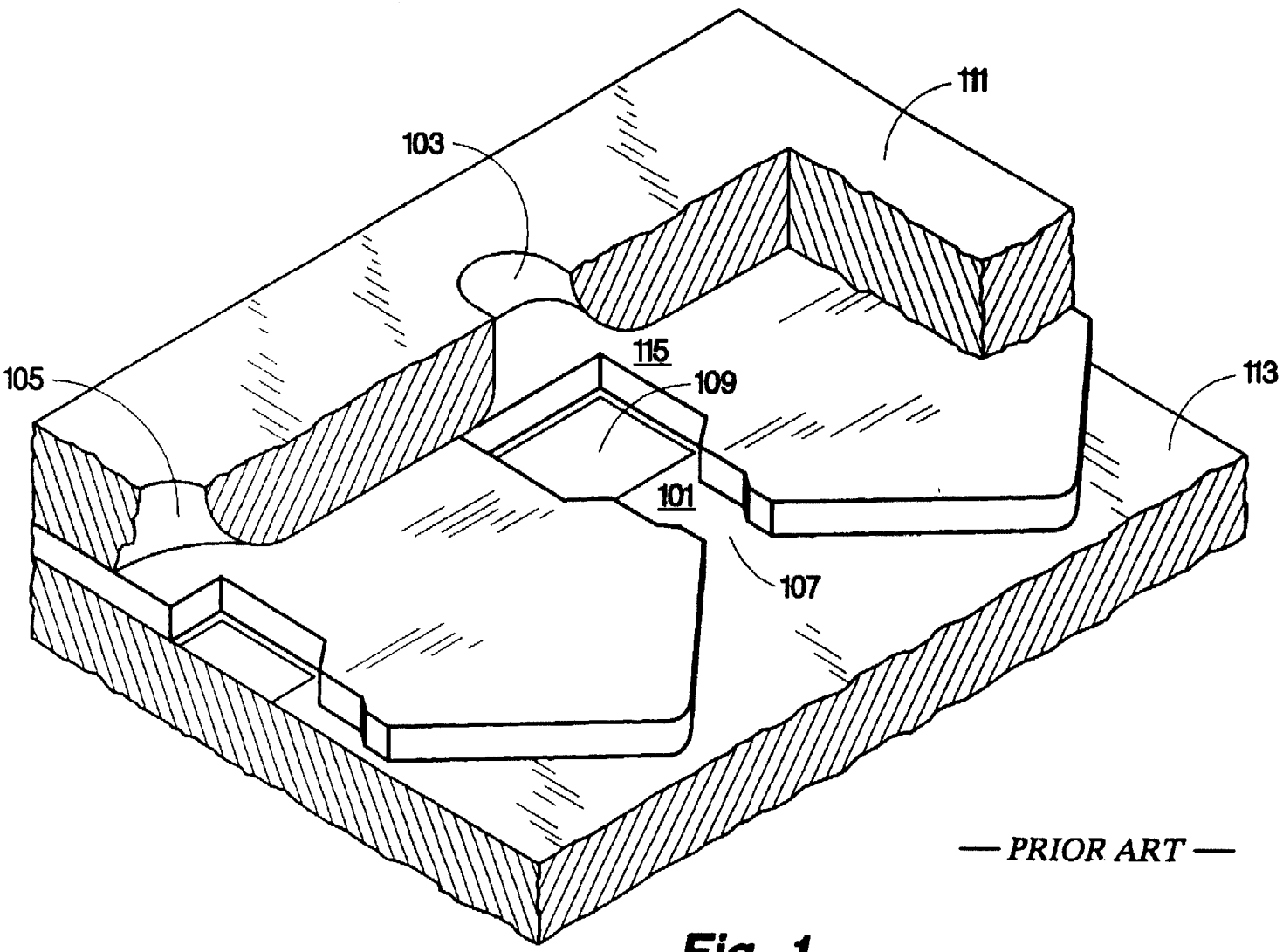
FIG. 1 is an isometric view of an inkjet printer printhead.

A greatly magnified isometric view of a portion of a typical thermal inkjet printhead for use in an inkjet printer is shown in FIG. 1. Several elements of the printhead have been sectioned to reveal an ink firing chamber 101 within the inkjet printhead. Many such firing chambers are typically arranged in a group around an ink supply plenum for efficient and high quality printing. Additional groups may be located in the printhead to allow for individual colors to be printed from each group. Associated with each firing chamber 101 is a orifice 103 disposed relative to the firing chamber 101 so that ink which is rapidly heated in the firing chamber by a heater resistor 109 is forcibly expelled as a droplet from the orifice 103. Part of a second orifice 105, associated with another ink firing chamber, is also shown.

The heater resistors are selected by a microprocessor and associated circuitry in the printer in a pattern related to the data entered to the printer so that ink which is expelled from selected orifices creates a defined character or figure of print on the medium. The medium (not shown) is typically held parallel to the orifice plate 111 and perpendicular to the direction of the ink droplet expelled from the orifice 103. Ink is supplied to the firing chamber 101 via an opening 107 commonly called an ink feed channel. This ink is supplied to the ink feed channel 107 from a much larger ink reservoir (not shown) by way of an ink plenum which is common to all firing chambers in a group.

Once the ink is in the firing chamber 101 it remains there until it is rapidly heated to boiling by the heater resistor 109. Conventionally, the heater resistor 109 is a thin film resistance structure disposed on the surface of a silicon substrate 113 and connected to electronic circuitry of the printer by way of conductors disposed on the substrate 113. The heater resistor placement is typically staggered in three or more parallel lines of heater resistors with adjacent heater resistors placed non-colinearly. Printheads having increased complexity typically have some portion of the electronic circuitry constructed in integrated circuit form on the silicon substrate 113. Various layers of protection such as passivation layers and cavitation barrier layers may further cover the heater resistor 109 to protect it fro corrosive and abrasive characteristics of the ink. Thus, the ink firing chamber 101 is bounded on one side by the silicon substrate 113 with its heater resistor 109 and other layers, and bounded on the other side by the orifice plate 111 with its attendant orifice 103. The other sides of the firing chamber 101 and the ink feed channel 107 are defined by a polymer barrier layer 115. This barrier layer is preferably made of an organic polymer plastic which is substantially inert to the corrosive action of ink and is conventionally deposited upon substrate 113 and its various protective layers and is subsequently photolithographically defined into desired geometric shapes and etched. Polymers suitable for the purpose of forming a barrier layer 115 include products sold under the names Parad, Vacrel, and Riston by E. I. DuPont De Nemours and Company of Wilmington, Del.. Such materials can withstand temperatures as high as 300 degrees C. and have good adhesive properties for holding the orifice plate of the printhead in position. Typically the barrier layer 115 has a thickness of about 19 to 30 micrometers after the printhead is assembled with the orifice plate 111.

The orifice plate 111 is secured to the silicon substrate 113 by the barrier layer 115. Typically the orifice plate 111 is constructed of nickel with a plating of gold to resist the corrosive effects of the ink. Typically the diameter of an orifice 103 in the orifice plate 111 ranges from 25 to 52 micrometers.

Figure 2:
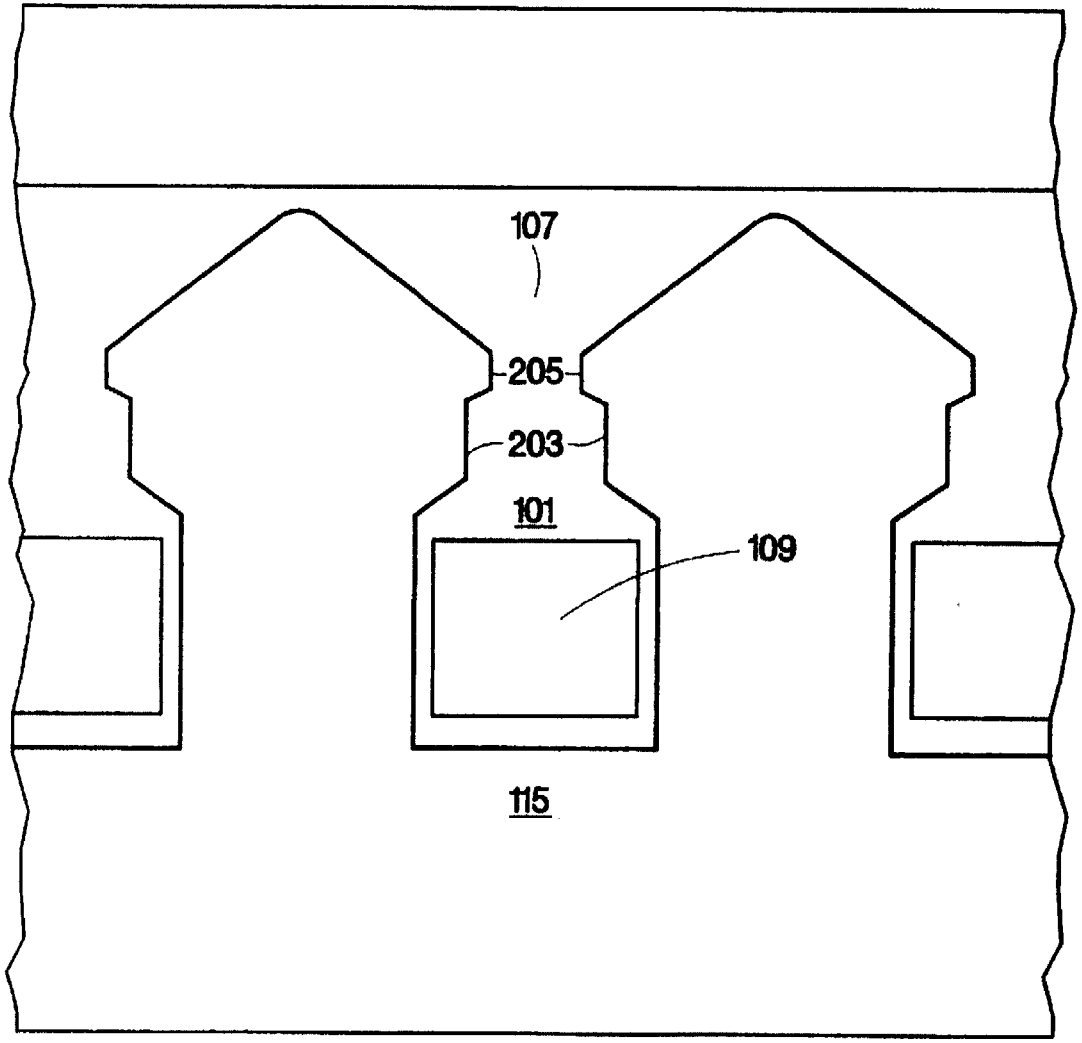
FIG. 2 is a planar view of the barrier layer and substrate of the printhead of FIG. 1.

A plan view of the barrier material in a conventional printhead of FIG. 1 is shown in FIG. 2. The heater resistor 109 is disposed in the firing chamber 101 and ink is supplied via the ink feed channel 107. In order to dampen the flow of ink back toward the ink source, the ink feed channel 107 has been given a series of constrictions 203 and 205 of decreasing channel width and dependent upon the distance from the heater resistor 109. Such a configuration has been found to provide satisfactory isolation and diminished crosstalk but at the cost of firing chamber ink refill speed.

Figure 3:
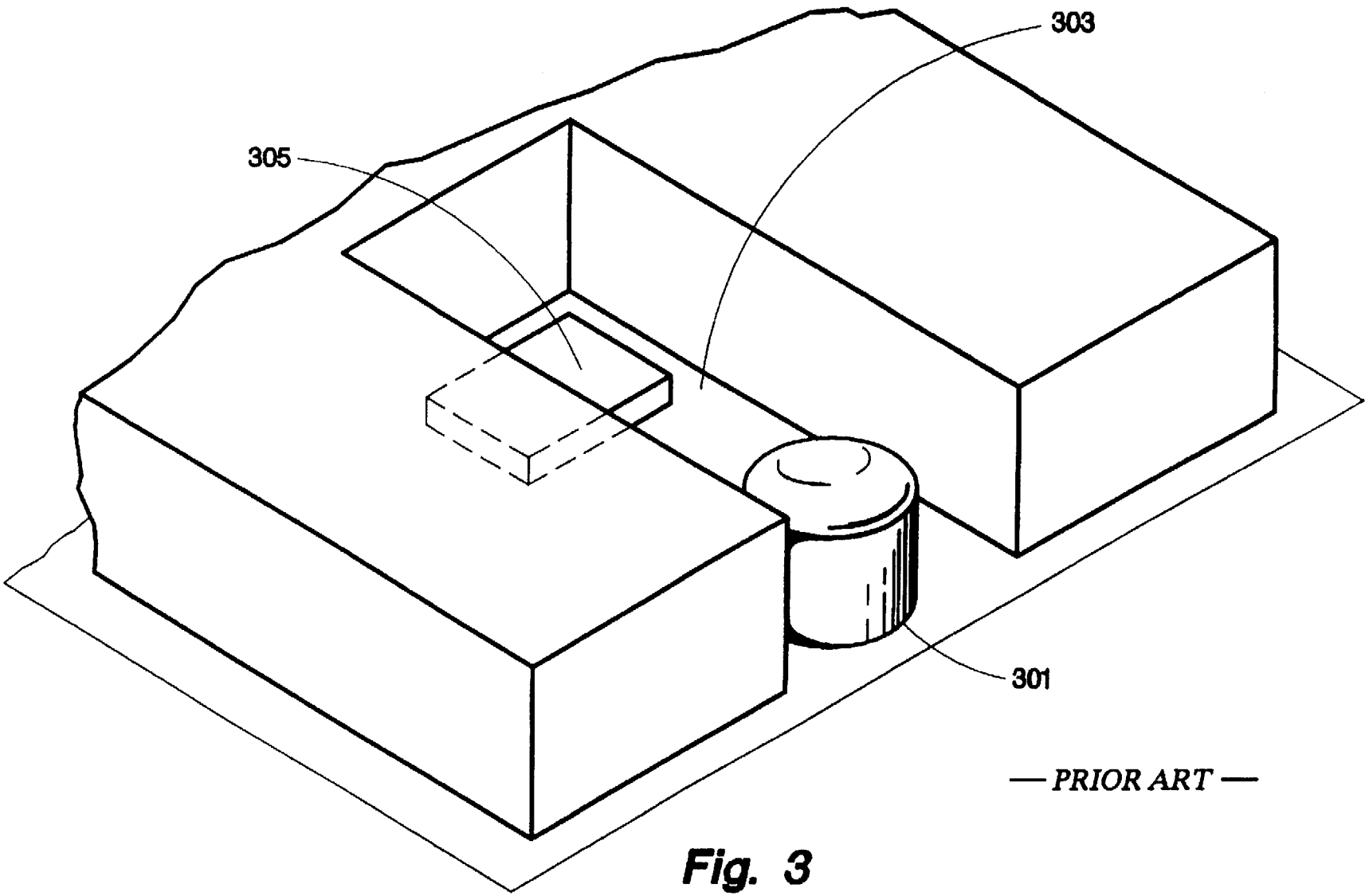
FIG. 3 is an isometric view of a conventional barrier layer architecture which employs a pillar at the entry to the firing chamber.

Others have added constrictions or other impediments to ink flow to the firing chamber in order to control the fluid resistance and other parameters of the ink flow to and from the firing chamber. See, for example European Patent Application No. EP 0 314 486, published May 3, 1989. As depicted in FIG. 3, a pillar 301 may be added to the entrance to the ink firing chamber 303 to provide a lumped fluid resistive element in the ink feed channel to allow adjustment of the feed channel's resistive and inertial parameters. Thus, when the heater resistor 305 is energized, the "blow-back" of ink to the ink plenum is minimized by the pillar 301. It has been further recognized that such pillars near the ink feed channel can provide a filtering function for dust and other particles which may be present in the ink.

Figure 4:
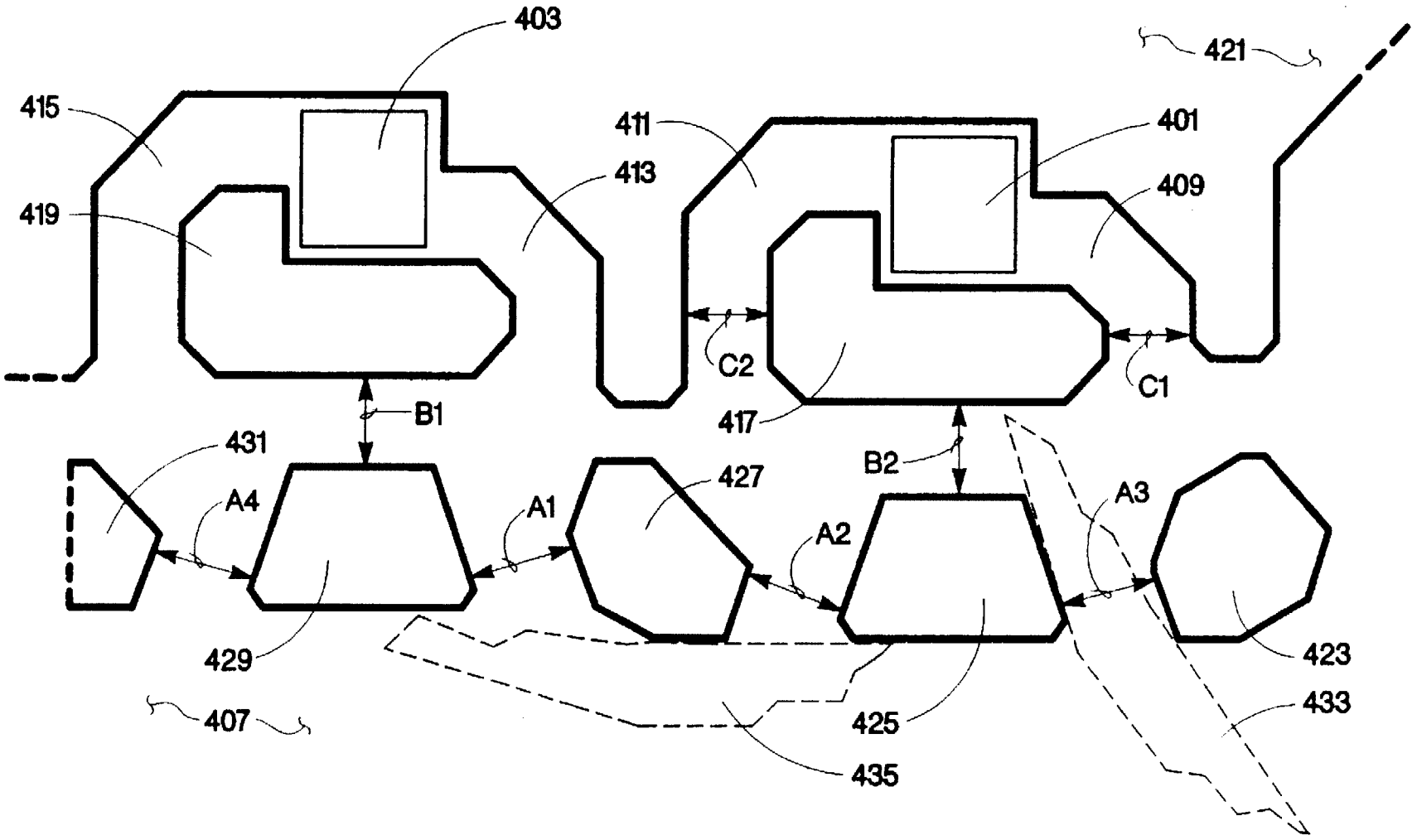
FIG. 4 is a planar view of the barrier layer and substrate of a printhead which may employ the present invention.

In order to realize an increased tolerance to particle blockage, the barrier material configuration for the ink feed channels and ink firing chambers has been architecturally designed in accordance with the present invention. A plan view of the barrier layer material of a preferred embodiment of the present invention is shown in FIG. 4.

Two heater resistors 401,403 are encompassed by their associated firing chambers and supplied ink from an ink plenum 407 by way of ink feed channels 409 and 411 (for firing resistor 401) and by way of ink feed channels 413 and 415 (for firing resistor 403). The ink plenum 407 is a comparatively large volume between the substrate and the orifice plate which is coupled to a large ink source and which is a reservoir for ink to be supplied to at least a set of firing chambers and, in some designs, to all of the firing chambers of a printhead. The ink feed channels are defined, in part by the barrier islands 417 and 419 and in part by the remainder of the barrier layer 421. Of course, the floor of the firing chamber is created by the surface of the semiconductor substrate and the ceiling of the firing chamber is formed by the orifice plate. The redundant ink feed channels provide protection from particulate matter which can be found in ink in that the probability that two particles of dust or pollen or the like will clog both ink feed channels of any one firing chamber is small.

In many instances a porous material such as a controlled-porosity ether-type polyurethane foam, in which the membrane walls have been further processed to enhance the capillary force of the foam, is used to store a quantity of ink for supply to the printhead. This capillary force provides a backpressure for the stored ink and prevents leakage due to changes in the surrounding environmental conditions. The use of such foam in inkjet printer cartridges has been further described in U.S. Pat. Nos. 4,771,295; 4,885,932; and 5,025,271.

Despite efforts to clean the porous material, it has been found that some particles remain in the porous material. The particles which have proven to be the most troublesome are elongate fibrous particles having one dimension approximately the size of the ink feed channel and another dimension 2 to 5 times the dimension of the ink feed channel. A particle with such an aspect ratio, in the absence of the present invention, can completely block one or more ink feed channels or can intrude into an ink feed channel and cover the firing resistor. Either event can cause the heater resistor to fail prematurely. A feature of the present invention is that an additional set of barrier islands is placed between the ink plenum and the redundant ink feed channels so that elongate particles are prevented from reaching the ink feed channels. Furthermore, the outer set of barrier islands are arranged so that an elongate particle would have to navigate sharp turns around the outer barrier islands in order to reach the firing chamber or the ink feed channels. Also, the ink feed channels themselves are configured in such a way that a particle must navigate a channel to the heater resistor which undergoes a right angle turn from the inlet to the outlet at the heater resistor. In the preferred embodiment, four barrier islands, 423, 425, 427, and 429 and part of a fifth barrier island 431 are shown in association with the ink feed channels 409–415. For each firing chamber, there exists two outer barrier islands and one inner, redundant channel-defining, barrier island. More than two outer barrier islands per firing chamber are possible but the number is finite and limited by the size of islands which would be created. As the area of the island decreases, the adhesion of any island to the substrate and the orifice plate decreases, thereby creating a potential problem that a small-area island will break away from its moorings and become a plug in its own right. The outer barrier islands are arranged in a line 502 which is parallel to the line formed by the placement of heater resistors. Since the heater resistors are typically staggered in three or more parallel lines of resistors, the lines of outer barrier islands are staggered but parallel as can be observed in FIG. 5 when comparing lines 502 and 504. Shown in broken line are two elongate particles 433 and 435 which have been trapped in the architecture of the preferred embodiment without blocking the flow of ink to the ink feed channel.

In the preferred embodiment, the redundant ink feed channels 409 and 411 supplying ink to the firing chamber surrounding the heater resistor 401 have a width dimension C1=C2=25 μm, defined by the barrier material. Ink entering the inlet of ink feed channel 409 flows in a direction away from the ink plenum 407 and toward the firing chamber. The ink feed channel 409 is designed to have a left mm (as viewed from the bottom of FIG. 4), resulting in a right angle change in the direction of ink flow. In a similar manner, the ink feed channel 411 is designed to have a right turn, also resulting in a right angle change of ink flow direction. Even if an elongate particle is able to avoid the outer barrier islands and enter one of the ink feed channels, it is unlikely that the particle will be able to make the right angle change of direction and become lodged over the heater resistor.

One essentially trapezoidal outer barrier island 425 is associated with the heater resistor 401 and is located essentially in-line between the heater resistor and the ink plenum. The inner barrier island 417 is located between the heater resistor and the outer barrier island 425 and the spacing between the inner barrier island 417 and the outer barrier island 425 is B2=25 μm. A similar orientation and spacing is maintained for heater resistor 403, inner barrier island 419, and outer barrier island 429. Thus B1=25 μm. These gaps provide an avenue for ink to flow to the ink channel inlets even though the ink feed gaps between some of the outer barrier islands may be blocked Coy a particle such as particle 435).

Figure 5:
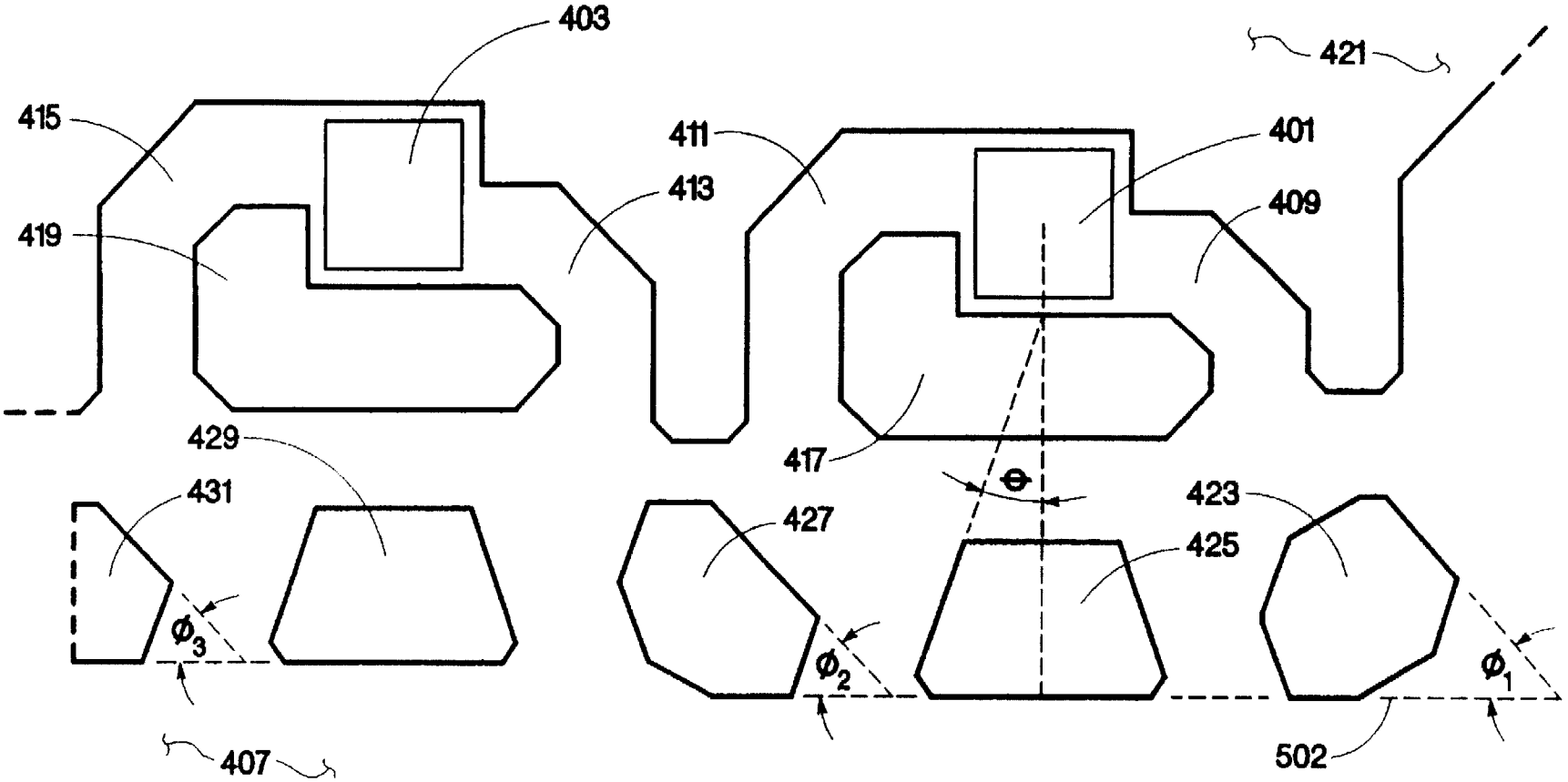
FIG. 5 is a planar view of the barrier layer and substrate similar to that in FIG. 4 and showing the topographic relationships of the barrier islands.

The second outer barrier island 427 associated with heater resistor 401 is located between outer barrier islands 425 and 429. The ink feed gap which is formed between the outer barrier island 427 and the outer barrier island 425 has a minimum channel width of A2=30 μm. Likewise, the ink feed gap which is formed between outer barrier islands 429 and 427 has a minimum channel width of A1=30 μm. The ink feed gap widths for all of the outer barrier islands associated with heater resistors 403 and 401 each have a minimum channel width of A3=A4=30 μm. It is a feature of the present invention that the ink feed gap between the outer barrier islands utilize essentially parallel walls of adjacent outer barrier islands which are neither perpendicular nor parallel to the direction of ink flow from the ink plenum to the inlet of an ink feed channel. In the preferred embodiment as shown in FIG. 5, the angle θ formed by the parallel walls to the direction of ink flow from the plenum 407 is equal to 30°. This angle can range from approximately 25° to 45° and effectively block elongate particles from reaching and entering an ink feed channel inlet without adversely affecting the unblocked rate of ink flow to the ink feed channels.

The outer barrier islands 423, 427, and 431, which are not in a line from the heater resistor to the ink plenum, are also provided with a topology which reflects an ink pulse created by the nucleation of ink in a firing event away from the inlet of adjacent ink feed channels. One wall of these outer barrier islands which is opposite an ink feed channel which has a greater fluid resistance than an ink feed channel of lesser fluid resistance is designed to have an angled reflective surface such that an ink pulse emanating from the greater fluid resistance ink feed channel is directed away from the nearest lesser fluid resistance ink feed channel. The advantages of ink feed channels having differing fluid resistances is set forth in U.S. patent application Ser. No. 08/282,243, "Inkjet Printhead with Tuned Firing Chambers and Multiple Inlets", filed on behalf of Burke et al. on Jul. 29, 1994. In the preferred embodiment, outer barrier islands 423, 425, and 427 have a wall which forms an angle, $\phi_1=\phi_2=\phi_3=45°\pm10°$, with a line perpendicular to the ink pulse output from the inlet of an ink feed channel. Therefore, ink pulse output from ink feed channel 411, for example, striking the wall of outer barrier island 427 is reflected away from the inlet of feed channel 413.

Due to the placement of the barrier islands, their configuration, and the width of the ink channels formed between them, the elongate particles found in the ink are unlikely to reach the ink feed channels and therefore are unable to cover the heater resistor or to block both inlets to any one ink firing channel.

We claim:

1. A barrier layer for an inkjet printhead which utilizes heater resistors disposed essentially in one or more parallel lines on a substrate, the barrier layer formed in association with the heater resistors to create an ink firing chamber at each heater resistor and an ink plenum which contains ink for distribution to at least some of the ink firing chambers, the barrier layer comprising:

a plurality of inner barrier islands, each barrier island associated with a respective one of said heater resistors, disposed between an ink firing chamber associated with said respective one of said heater resistors and said ink plenum, and forming two ink feed channels to enable ink to be supplied to said respective one of said heater resistors; and a plurality of outer barrier islands having a number equal to at least twice the number of inner barrier islands, disposed between said inner barrier island and said ink plenum to prevent unwanted particles in the ink from reaching the ink feed channels, and arranged essentially in lines parallel to the one or more parallel lines of heater resistors.

2. A printhead in accordance with claim 1 wherein said ink feed channel first dimension further comprises a width of 25 μm.

3. A barrier layer for an inkjet printer printhead in accordance with claim 1 wherein each said ink feed channel further comprises an inlet and an outlet to said ink firing chamber, said inlet disposed perpendicularly to said outlet whereby ink flowing toward said ink firing chamber is required to make essentially a right angle turn to reach said ink firing chamber.

4. A barrier layer for an inkjet printer printhead in accordance with claim 1 further comprising a first of said plurality of outer barrier islands associated with said respective one of said heater resistors, disposed about a line from said respective one of said heater resistors perpendicular to said line of outer barrier islands, and spaced apart from said inner barrier island by a second dimension.

5. A barrier layer for an inkjet printer printhead in accordance with claim 4 wherein said second dimension further comprises a spacing of 25 μm.

6. A barrier layer for an inkjet printer printhead in accordance with claim 1 further comprising a second of said plurality of outer barrier islands adjacent said first of said plurality of outer barrier islands, having a first wall essentially parallel to a wall of said first of said plurality of outer barrier islands to form an ink feed gap.

7. A barrier layer for an inkjet printer printhead in accordance with claim 6 wherein said second of said plurality of outer barrier islands further comprises a second wall disposed essentially opposite an inlet of one of said two ink feed channels and forming a first acute angle with said line of outer barrier islands.

8. A barrier layer for an inkjet printer printhead in accordance with claim 7 wherein said first acute angle further comprises an angle between 35° and 55°.

9. A barrier layer for an inkjet printer printhead in accordance with claim 7 wherein said parallel walls of said first and second plurality of outer barrier islands further comprise a second acute angle with said line from said respective one of said heater resistors to said line of outer barrier islands.

10. A barrier layer for an inkjet printer printhead in accordance with claim 9 wherein said second acute angle further comprises an angle between 25° and 45°.

11. A barrier layer for an inkjet printer printhead in accordance with claim 6 wherein said ink feed gap has a third dimension further comprising a spacing of 30 μm.

12. A printhead for an inkjet printer comprising:

a semiconductor substrate having a plurality of heater resistors disposed essentially in one or more parallel lines on said semiconductor substrate;

an orifice plate disposed essentially parallel to said semiconductor substrate;

a barrier layer disposed between said semiconductor substrate and said orifice plate and having spaces in said barrier layer defining an ink plenum and a plurality of ink firing chambers, each of said plurality of firing chambers associated with a respective one of said plurality of heater resistors, said barrier layer including:

a plurality of inner barrier islands, each barrier island associated with a respective one of said heater resistors, disposed between an ink firing chamber associated with said respective one of said heater resistors and said ink plenum, and forming two ink feed channels each having a first dimension to enable ink to be supplied to said respective one of said heater resistors and each ink feed channel having an inlet and an outlet to said ink firing chamber, said inlet disposed perpendicularly to said outlet whereby ink flowing toward said ink firing chamber is required to make essentially a right angle turn to reach said ink firing chamber, and a plurality of outer barrier islands having a number equal to twice the number of inner barrier islands, disposed between said inner barrier island and said ink plenum to prevent unwanted particles in the ink from reaching the ink feed channels, and arranged essentially in lines parallel to said one or more parallel lines of heater resistors; a first of said plurality of outer barrier islands associated with said respective one of said heater resistors, disposed about a line from said respective one of said heater resistors perpendicular to said line of outer barrier islands, and spaced apart from said inner barrier island by a second dimension; a second of said plurality of outer barrier islands adjacent said first of said plurality of outer barrier islands, having a first wall essentially parallel to a wall of said first of said plurality of outer barrier islands to from an ink feed gap and a second wall, essentially opposite an inlet of one of said two ink feed channels, forming a first acute angle with said line of outer barrier islands, said parallel walls of said first and second plurality of outer barrier islands forming a second acute angle with said line from said respective one of said heater resistors to said line of outer barrier islands.

13. A printhead in accordance with claim 12 wherein said ink feed channel first dimension further comprises a width of 25 μm, wherein said second dimension further comprises a spacing of 25 μm, and wherein said ink feed gap has a third dimension further comprising a spacing of 30 μm.

14. A printhead in accordance with claim 12 wherein said first acute angle further comprises an angle between 35° and 55° and wherein said second acute angle further comprises an angle between 25° and 45°.

15. A method of creating a barrier layer for an inkjet printhead having heater resistors disposed essentially in one or more parallel lines on a substrate, in which the barrier layer is formed in association with the heater resistors to create an ink firing chamber at each heater resistor and an ink plenum which contains ink for distribution to at least some of the ink firing chambers, the method comprising the steps of:

disposing, for each firing chamber, an inner barrier island between an ink firing chamber associated with one of said heater resistors and said ink plenum, thereby forming two ink feed channels to enable ink to be supplied to said respective one of said heater resistors; and disposing, for each firing chamber, two outer barrier islands between said inner barrier island and said ink plenum to prevent unwanted particles in the ink from reaching the ink feed channels, in an arrangement of lines essentially parallel to said one or more parallel lines of heater resistors.

16. A method in accordance with the method of claim 15 wherein the step of disposing an inner barrier island further comprises the step of disposing an inlet perpendicular to an outlet to said ink firing chamber.

17. A method in accordance with the method of claim 15 wherein the step of disposing two outer barrier islands further comprises the step of disposing a first of said plurality of outer barrier islands associated with said respective one of said heater resistors about a line from said respective one of said heater resistors perpendicular to said line of outer barrier islands, and spaced apart from said inner barrier island by a second dimension.

18. A method in accordance with the method of claim 17 wherein the step of disposing two outer barrier islands further comprises the steps of disposing a second of said plurality of outer barrier islands adjacent said first of said plurality of outer barrier islands, and creating a first wall of said second of said plurality of outer barrier islands essentially parallel to a wall of said plurality of outer barrier islands to form an ink feed gap.

19. A method in accordance with the method of claim 18 wherein the step of disposing two outer barrier islands further comprises the step of creating in said second of said plurality of outer barrier islands a second wall making a first acute angle with said line of outer barrier islands and disposed essentially opposite an inlet of one of said two ink feed channels.

20. A method in accordance with the method of claim 19 wherein the step of disposing two outer barrier islands further comprises the step of disposing said parallel walls of said first and second plurality of outer barrier islands to make a second acute angle with said line from said respective one of said heater resistors to said line of outer barrier islands.

* * * * *

UNITED STATES PATENT AND TRADEMARK OFFICE

CERTIFICATE OF CORRECTION

PATENT NO. : 5,734,399
DATED : March 31, 1998
INVENTOR(S) : Timothy L. Weber et al.

It is certified that error appears in the above-identified patent and that said Letters Patent is hereby corrected as shown below:

Column 2,
Line 13, replace the word “tikering” with the word -- filtering --.
Line 28, replace the word “tiring” with the word -- firing --.

Column 5,
Line 37, replace the text “mm” with the word -- turn --.
Line 46, replace the text “Coy” with the text -- (by --.

Signed and Sealed this

Twelfth Day of November, 2002

*Attest:*

*Attesting Officer*

JAMES E. ROGAN
*Director of the United States Patent and Trademark Office*